US006377113B1

(12) United States Patent
Kanno

(10) Patent No.: US 6,377,113 B1
(45) Date of Patent: Apr. 23, 2002

(54) REFERENCE CURRENT GENERATING CIRCUIT

(75) Inventor: Kiyoshi Kanno, Tokyo (JP)

(73) Assignee: NEC Corporation, Tokyo (JP)

( * ) Notice: Subject to any disclaimer, the term of this patent is extended or adjusted under 35 U.S.C. 154(b) by 689 days.

(21) Appl. No.: 08/729,399

(22) Filed: Oct. 11, 1996

(30) Foreign Application Priority Data

Oct. 11, 1995 (JP) ..... 7-289318

(51) Int. Cl.[7] ..... G05F 3/02
(52) U.S. Cl. ..... 327/543; 323/315
(58) Field of Search ..... 327/334, 538, 327/543, 546; 323/312, 315

(56) References Cited

U.S. PATENT DOCUMENTS

| | | | | |
|---|---|---|---|---|
| 4,198,622 A | | 4/1980 | Connolly, Jr. et al. | |
| 4,251,743 A | | 2/1981 | Hareyama | |
| 4,331,913 A | * | 5/1982 | Sparber | 323/315 |
| 4,354,175 A | | 10/1982 | Goldstein | |
| 5,459,684 A | * | 10/1995 | Nakamura et al. | 365/149 |
| 5,504,447 A | * | 4/1996 | Eggling | 327/564 |
| 5,568,084 A | * | 10/1996 | McClure et al. | 327/538 |
| 5,640,122 A | * | 6/1997 | McClure et al. | 327/530 |
| 5,654,663 A | * | 8/1997 | McClure et al. | 327/530 |
| 5,675,280 A | * | 10/1997 | Nomura et al. | 327/538 |

FOREIGN PATENT DOCUMENTS

| | | |
|---|---|---|
| EP | 0606888 | 7/1994 |
| JP | 59 66725 | 4/1984 |
| JP | 6331224 | 2/1988 |
| JP | 7170188 | 7/1995 |

OTHER PUBLICATIONS

Patent Abstracts of Japan, Publication No. 02145012, vol. 14, No. 391 (E–0968) Jun. 4, 1990.
Patent Abstracts of Japan, Publication No. 59066725, vol. 008, No. 171 (P–293) Apr. 16, 1984.
Patent Abstracts of Japan, Publication No. 03172906, vol. 15, No. 424 (P–1268) Jul. 26, 1991.

* cited by examiner

*Primary Examiner*—Terry D. Cunningham
(74) *Attorney, Agent, or Firm*—Sughrue Mion, PLLC

(57) ABSTRACT

In a reference current generating circuit, a gate voltage of a MOS transistor for supplying a reference current, is controlled by a selected one of a plurality of different divided voltages obtained from a reference voltage by a resistor ladder circuit internally provided in an integrated circuit. Thus, it is possible to supply the reference current having a high precision and a high stability in relation to a variation of the threshold $V_T$ of the MOS transistor caused by a variation in the manufacturing process and a temperature change. On the other hand, an external resistor, which was required in the prior art reference current generating circuit, is no longer necessary.

10 Claims, 4 Drawing Sheets

REFERENCE CURRENT GENERATING CIRCUIT

BACKGROUND OF THE INVENTION

1. Field of the Invention

The present invention relates to a reference current generating circuit, and more specifically to a reference current generating circuit suitable to be incorporated in a MOS semiconductor integrated circuit.

2. Description of Related Art

In the prior art, for example, Japanese Patent Application Laid-open Publication No. JP-A-59-066725 proposed a reference current generating circuit (constant current circuit) as shown in FIG. 1.

The shown prior art constant current circuit includes a differential amplifier 11 having a non-inverting input (+) connected to receive an input reference voltage $V_0$, an NMOS transistor (N-channel metal-oxide-semiconductor field effect transistor) 12 having a gate connected to an output of the differential amplifier 11 and a source connected to an inverting input (−) of the differential amplifier 11, and a constant current generating reference resistor 13 having a resistance $R_0$ having one end connected at a connected node "a" between the source of the transistor 12 and the inverting input of the differential amplifier 11. The other end of the resistor 13 is grounded. A drain of the transistor 12 is connected to a constant current output OUT2.

Assuming that the reference voltage $V_0$ is applied to the non-inverting input of the differential amplifier 11, a potential of the node "a" becomes $V_0$ because of a feedback action, and therefore, a current $I_0$ flowing through the constant current output OUT2 becomes as follows:

$$I_0=V_0/R_0$$

In this type of the constant current circuit, since the current value $I_0$ is determined by the reference voltage value $V_0$ and the resistance value $R_0$ of the constant current generating reference resistor 13, it is possible to relatively easily set the constant current value $I_0$.

In general, due to a process variation in a conventional semiconductor device manufacturing process, and due to an ambient temperature variation, large variation or fluctuation occurs in a threshold level $V_T$ and other characteristics of MOS transistors and a resistance value of diffused resistors.

Because of this reason, in order to realize a precise reference current value in the reference current generating circuit shown in FIG. 1, it has been necessary to externally mount the constant current generating reference resistor 13. As a result, the number of parts is inevitably increased in the conventional reference current generating circuit, which is not convenient to the integrated circuit.

On the other hand, a precision resistor itself is expensive, and therefore, in order to obtain a high precise reference current, the conventional reference current generating circuit inevitably becomes expensive.

Furthermore, since the integrated circuit is required to have output terminals for the external resistor, the number of output terminals of the integrated circuit is increased as a matter of course.

Assuming that the constant current generating reference resistor 13 is internally formed in the integrated circuit in the form of a diffused resistor, in place of the external resistor, it is not possible to realize a precise reference current generating circuit because the variation of the resistance of the diffused resistor dependent upon a temperature change is large if an internal resistor was simply formed in the inside of the integrated circuit.

SUMMARY OF THE INVENTION

Accordingly, it is an object of the present invention to provide a reference current generating circuit which has overcome the above mentioned defects of the conventional circuit.

Another object of the present invention is to provide a reference current generating circuit suitable to be incorporated in a MOS semiconductor integrated circuit and capable of generating a precise reference current without being influenced by variation of the threshold $V_T$ of the transistor and a temperature change.

The above and other objects of the present invention are achieved in accordance with the present invention by a reference current generating circuit comprising a reference voltage generating means, a resistor ladder circuit connected to the reference voltage generating means and having a predetermined number of taps for outputting a corresponding number of different divided voltages obtained from a voltage generated by the reference voltage generating means, a control circuit connected to the predetermined number of taps of the resistor ladder circuit, for outputting a selected divided voltage of the different divided voltages, and a MOS transistor having a gate connected to receive the selected divided voltage and a source connected to a reference power supply terminal, a current flowing through a drain of the MOS transistor being extracted as an output reference current.

With the above mentioned arrangement, the gate voltage of the MOS transistor is controlled by the control circuit to a level which enables the MOS transistor to generate a desired constant current, by selecting one of a plurality of different divided voltages obtained by the resistor ladder circuit from the reference voltage generated by the reference voltage generating means. Accordingly, a reference current generating circuit can be realized, which is capable of supplying a reference current having a high precision and a high stability in relation to a variation of the threshold $V_T$ of the MOS transistor caused by a variation in the manufacturing process and a temperature change. On the other hand, an external resistor, which was required in the prior art reference current generating circuit, becomes unnecessary. Therefore, the reference current generating circuit in accordance with the present invention is suitable to be incorporated in an integrated circuit, and can reduce the cost of the semiconductor device.

The above and other objects, features and advantages of the present invention will be apparent from the following description of preferred embodiments of the invention with reference to the accompanying drawings.

DESCRIPTION OF THE PREFERRED EMBODIMENTS

Figure 1:
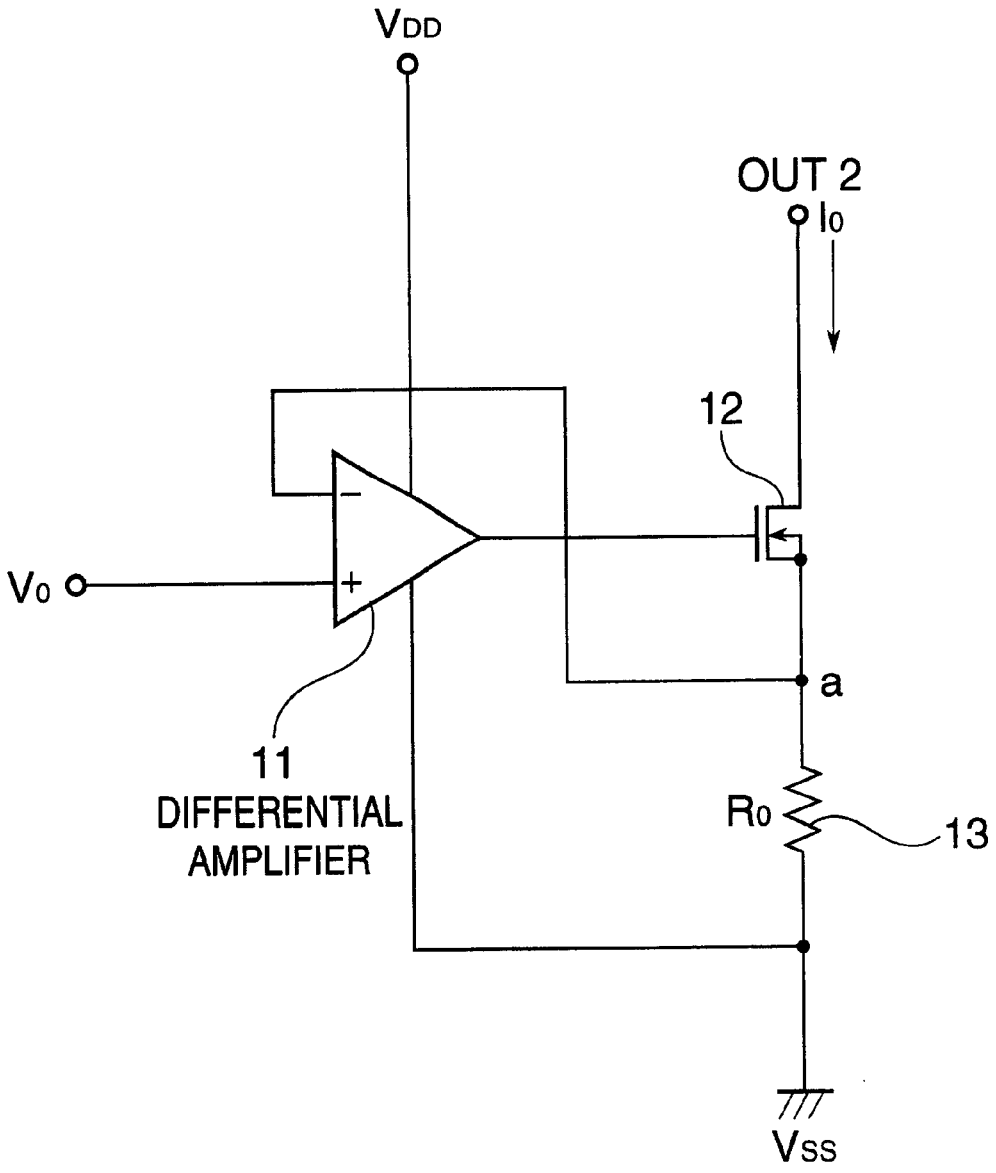
FIGURE 1 PRIOR ART
FIG. 1 is a circuit diagram of the prior art reference current generating circuit.
Figure 2:
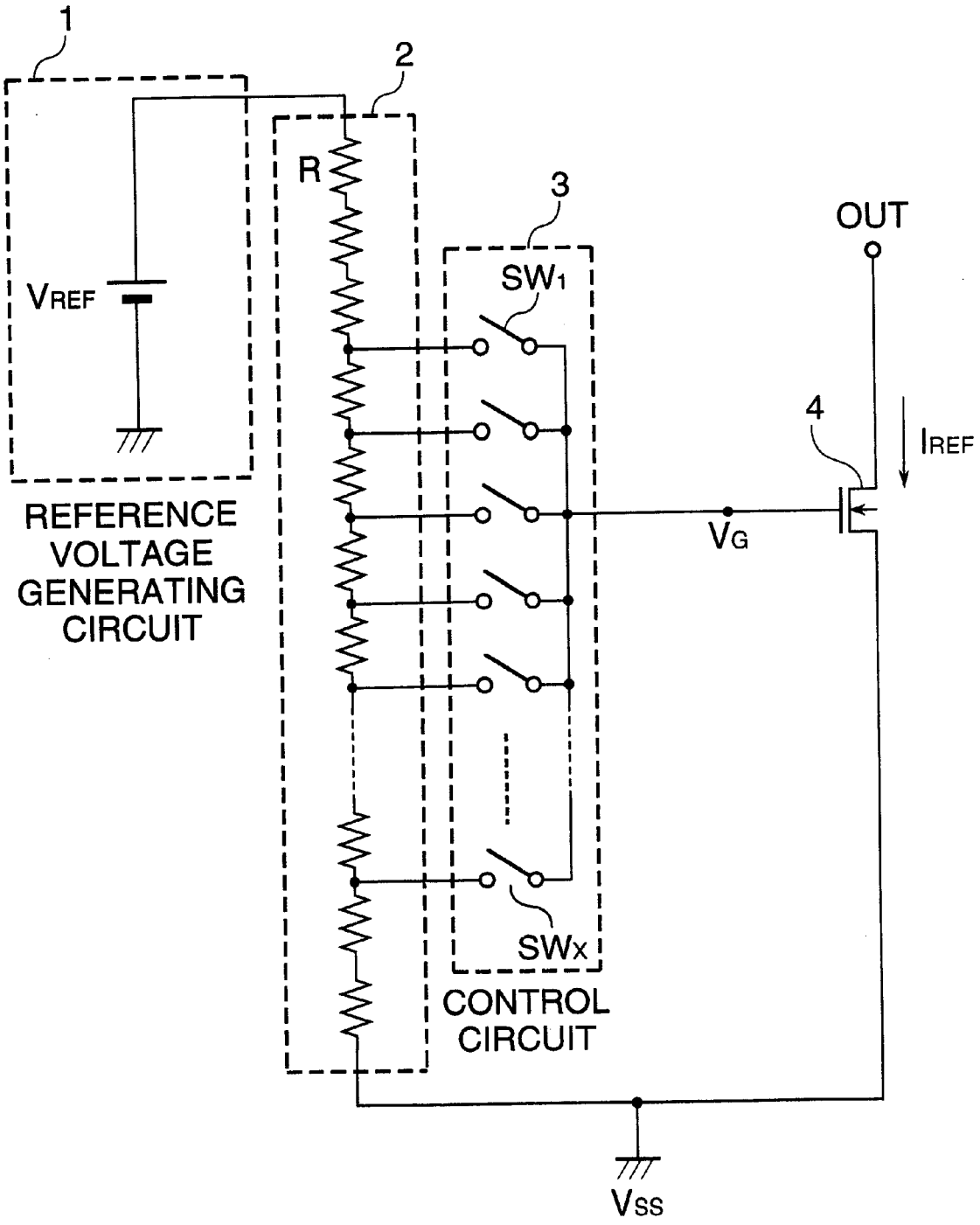
FIG. 2 is a circuit diagram of a first embodiment of the reference current generating circuit in accordance with the present invention.

Referring to FIG. 2, there is shown a circuit diagram of a first embodiment of the reference current generating circuit in accordance with the present invention.

The shown first embodiment includes a reference voltage generating circuit for generating a reference voltage $V_{REF}$, and a resistor ladder circuit (resistor string) 2 composed of a number of series-connected resistors R and having one end connected to an output terminal of the reference voltage generating circuit 1 and the other end connected to a low voltage power supply terminal $V_{SS}$. This resistor ladder circuit 2 includes a predetermined number of taps for outputting a corresponding number of different divided voltages obtained from the reference voltage $V_{REF}$. The shown embodiment also includes a control circuit 3 connected to the predetermined number of taps of the resistor ladder circuit 2, for outputting a selected divided voltage of the different divided voltages, and an NMOS transistor 4 having a gate connected to an output of the control circuit 3.

The control circuit 3 includes switches $SW_1$ to $SW_X$ of the same number as that of the taps of the resistor ladder circuit 2. One end of each of the switches $SW_1$ to $SW_X$ is connected to a corresponding one tap of the taps of the resistor ladder circuit 2, and the other end of the switches $SW_1$ to $SW_X$ are connected in common to the output of the control circuit 3, which is connected to the gate of the NMOS transistors 4.

A source of the NMOS transistor 4 is connected to low voltage power supply terminal $V_{SS}$, and a drain of the NMOS transistor 4 is connected to an output terminal OUT.

Now, operation of the shown embodiment will be described.

Assume that the resistor ladder circuit is formed of "n" unitary resistors having the same resistance R, namely, the resistor ladder circuit 2 is equally divided by "n". In the invention, "n" is not smaller than 4, but in the shown embodiment, "n" is larger than 10.

In the order of the switch $SW_1$ to the switch $SW_X$, a potential on different connection nodes between the taps of the resistor ladder circuit 2 and the switches $SW_1$ to $SW_X$ of the control circuit 3 can be expressed as $$((n-3)/n)\times V_{REF},\ ((n-4)/n)\times V_{REF},\ ((n-5)/n)\times V_{REF},\ \ldots$$

If only one of the switches $SW_1$ to $SW_X$ of the control circuit 3 is closed, the potential on the corresponding tap of the resistor ladder circuit 2 corresponding to the closed switch, is outputted from the control circuit 3 as the gate voltage $V_G$ of the NMOS transistor 4.

If the NMOS transistor 4 is in a saturated region, a drain current $I_{REF}$ of the NMOS transistor 4 can be expressed:

$$I_{REF}=K(V_G-V_{SS}-V_T)^2 \quad (1)$$

where K is a transconductance coefficient of the NMOS transistor.

$V_G$ is a gate voltage of the NMOS transistor $V_T$ is a threshold voltage of the NMOS transistor.

$V_{SS}$ is a source voltage of the NMOS transistor which is equal to the voltage of the low voltage power supply terminal.

Here, K can be expressed as follows:

$$K=(1/2)\mu Cox(W/L) \quad (2)$$

where $\mu$ is a carrier mobility in the channel.

Cox is a gate oxide film capacitance per unitary area.

W is a gate width.

L is a gate length.

In the above mentioned embodiment, if the output current $I_{REF}$ does not become a desired predetermined value because of variation of the threshold $V_T$ of the NMOS transistor, the closed switch is changed to another closed switch in the control circuit 3 so as to change the output gate voltage $V_G$, thereby to realize the output current $I_{REF}$ corresponding to the desired predetermined value.

Figure 3:
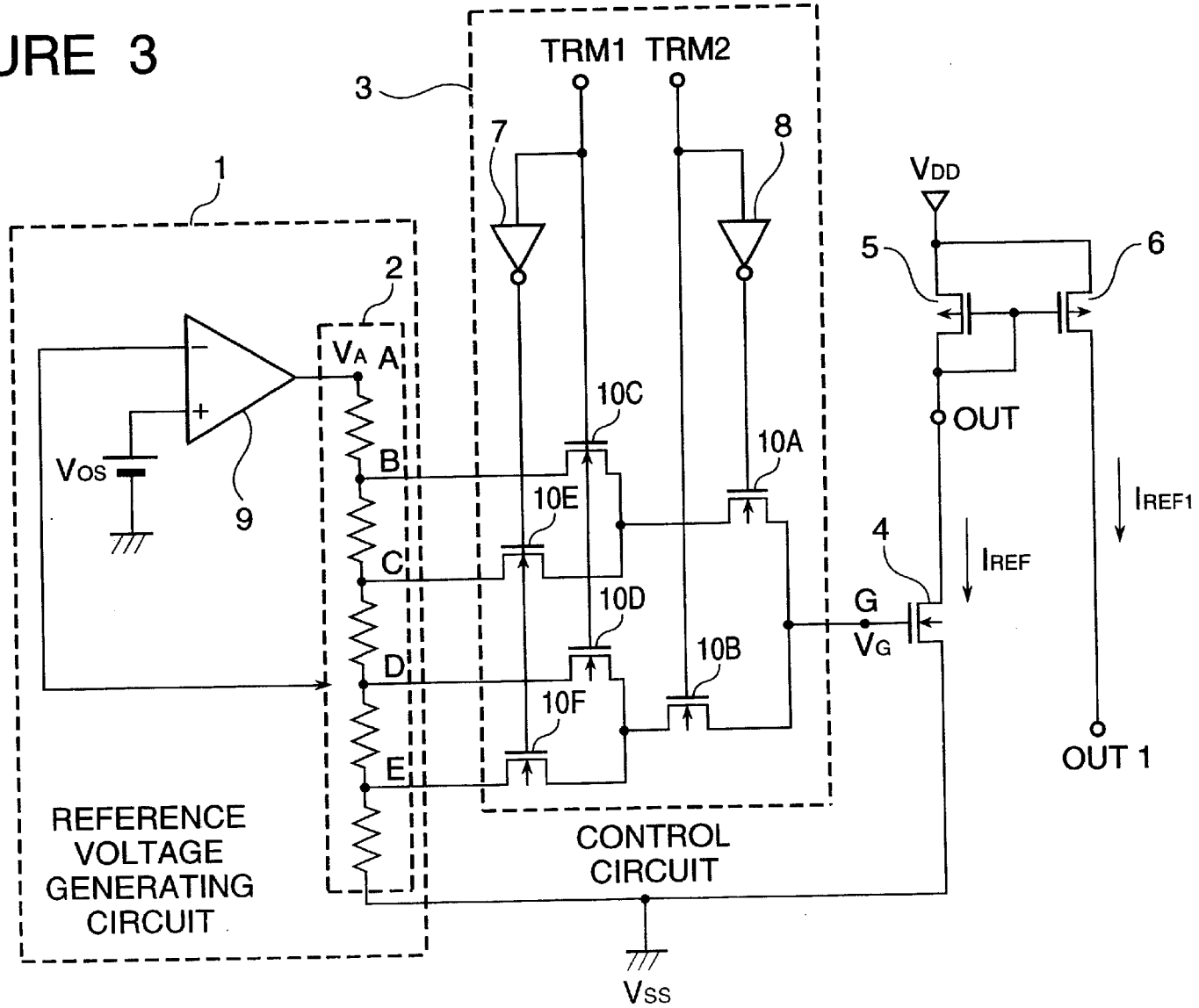
FIG. 3 is a detailed circuit diagram of a second embodiment of the reference current generating circuit in accordance with the present invention.

Referring to FIG. 3, there is shown a detailed circuit diagram of a second embodiment of the reference current generating circuit in accordance with the present invention.

In the second embodiment, the reference voltage generating circuit 1 includes a differential amplifier 9 having an offset voltage $V_{OS}$ and an equal-divided resistor ladder circuit 2, which are connected to constitute a non-inverting amplifier generating a reference voltage at its output.

Specifically, a non-inverting input of the differential amplifier 9 is connected to the offset voltage $V_{OS}$, and the output of the differential amplifier 9 is connected at a node "A" to one end of the resistor ladder circuit 2, the other end of which is connected to a low voltage power supply terminal $V_{SS}$. An inverting input of the differential amplifier 9 is connected to a suitable intermediate point- of the resistor ladder circuit 2, so that a stable reference voltage is outputted from the output of the differential amplifier 9.

With the non-inverting amplifier thus formed, a potential of the intermediate point of the resistor ladder circuit 2, which is connected to the inverting input of the differential amplifier 9, is expressed:

$$\{R_2/(R_1+R_2)\}\times VA$$

where $V_A$ is a potential of the output terminal "A" of the differential amplifier 9.

$R_1$ is a resistance of a resistor ladder portion between the output terminal "A" of the differential amplifier 9 and the intermediate point of the resistor ladder circuit 2, which is connected to the inverting input of the differential amplifier 9, $R_2$ is a resistance of a resistor ladder portion between the low voltage power supply terminal $V_{SS}$ and the intermediate point of the resistor ladder circuit 2, which is connected to the inverting input of the differential amplifier 9, In addition, this potential of the intermediate point of the resistor ladder circuit 2, which is connected to the inverting input of the differential amplifier 9, is fundamentally equal to the offset voltage $V_{OS}$ at the non-inverting input of the of the differential amplifier 9, and therefore, the output voltage $V_A$ is adjusted by the offset voltage $V_{OS}$, as follows:

$$V_A=\{(R_1+R_2)/R_2\}\times V_{OS}$$

In the second embodiment shown in FIG. 3, a ladder resistor circuit for dividing the reference voltage generated by the reference voltage generating circuit 1 is not independently provided, but is used in common to the voltage trimming resistor ladder circuit 2 internally provided in the reference voltage generating circuit 1. In other words, different divided voltages of the reference voltage $V_A$ generated in the resistor ladder circuit 2 are used not only for a voltage trimming for making the reference voltage $V_A$ at a constant value, but also supplied to the control circuit 3.

In the shown second embodiment, the resistor ladder circuit 2 is equally divided by "5", and voltage of four nodes B, C, D and E are supplied to the control circuit 3.

The control circuit 3 of the second embodiment includes a pair of control signal input terminals TRM1 and TRM2, a pair of inverters 7 and 8, six transfer gates (pass transistors) 10A, 10B, 10C, 10D, 10E and 10F each formed of an NMOS transistor, which are connected as shown. The node B is connected to a source of the transfer gate transistor 10C having a gate connected to the control signal input terminal TRM1, and the node C is connected to a source of the transfer gate transistor 10E having a gate connected to an output of the inverter 7 having an input connected to the control signal input terminal TRM1. The node D is connected to a source of the transfer gate transistor 10D having a gate connected to the control signal input terminal TRM1, and the node E is connected to a source of the transfer gate transistor 10F having a gate connected to the output of the inverter 7. A drain of each of the transfer gate transistors 10C and 10E is connected in common to a source of the transfer gate transistor 10A having a gate connected to an output of the inverter 8 having an input connected to the control signal input terminal TRM2. A drain of each of the transfer gate transistors 10D and 10F is connected in common to a source of the transfer gate transistor 10B having a gate connected to the control signal input terminal TRM2. A drain of each of the transfer gate transistors 10A and 10B is connected in common to a node "G" to constitute an output of the control circuit 3. Namely, the six transfer gate transistors 10A, 10B, 10C, 10D, 10E and 10F constitute a so-called tree structure between the gate of NMOS transistor 4 and the nodes "B", "C", "D" and "E" of the resistor ladder circuit 2.

It will be understood to persons skilled in the art that, by controlling a pair of control signals supplied to the control signal input terminals TRM1 and TRM2, the on-off of the six transfer gate transistors 10A, 10B, 10C, 10D, 10E and 10F can be controlled so that the voltage value $V_G$ outputted onto the node "G" can be freely selected from the four divided voltages appearing on the nodes "B", "C", "D" and "E".

A source of the NMOS transistor 4 is connected to the low voltage power supply terminal $V_{SS}$, and a drain of the NMOS transistor 4 is connected to a drain of a PMOS (P-channel metal-oxide-semiconductor field effect transistor) 5. Tie drain of the PMOS transistor 5 is connected to a gate of the PMOS transistor 5 itself and also connected to a gate of another PMOS transistor 6. A source of these PMOS transistors 5 and 6 are connected to a high voltage power supply terminal $V_{DD}$. A drain of the PMOS transistor 6 constitutes a current output and is connected to an output terminal OUT1. With the above mentioned arrangement, tie PMOS transistors 5 and 6 are of the same size, and constitutes a current mirror circuit.

Thus, a drain current $I_{REF}$ of the NMOS transistor 4 is determined by the output voltage $V_G$ of the control circuit 3, and this drain current $I_{REF}$ is supplied to the current mirror circuit composed of the PMOS transistors 5 and 6 and connected between the high voltage power supply terminal $V_{DD}$ and the NMOS transistor 4, so that an output current $I_{REF1}$ corresponding to the drain current $I_{REF}$ is outputted from the output terminal OUT1. In this embodiment, the PMOS transistors 5 and 6 are of the same size as mentioned above, but, it would be a matter of course to persons skilled in the art that, by adjusting the size ratio of the PMOS transistors 5 and 6 of the current mirror circuit, it is possible to make the output current $I_{REF1}$ outputted from the output terminal OUT1, to desired times the drain current $I_{REF}$ of the NMOS transistor 4 (which constitutes an input current path or a reference current path of the current mirror circuit).

Now, a specific operation of the reference current generating circuit of the second embodiment shown in FIG. 3 will be described.

Assume that the voltage on the output node "A" of the reference voltage generating circuit 1 is $V_A$. When the voltage $V_A$ does not become a desired value because of variation of the threshold voltage $V_T$ of transistors dependently upon the variation of the manufacturing process, the resistor dividing ratio of the voltage trimming resistor ladder circuit 2 is adjusted.

Namely, the voltage $V_A$ is adjusted to the desired value by adjusting or changing the intermediate point of the resistor ladder circuit 2 connected to the inverting input of the differential amplifier 9.

Here, assuming that the resistance of the five resistors having the same resistance in the resistor ladder circuit 2 is "R", since the voltage of the node "A" is $V_A$, the four divided voltages appearing on the nodes "B", "C", "D" and "E" can be expressed as follows:

$$\text{Node "B"}\ (4R/5R)V_A=(4/5)V_A \tag{3A}$$

$$\text{Node "C"}\ (3R/5R)V_A=(3/5)V_A \tag{3B}$$

$$\text{Node "D"}\ (2R/5R)V_A=(2/5)V_A \tag{3C}$$

$$\text{Node "E"}\ (1R/5R)V_A=(1/5)V_A \tag{3D}$$

As seen from the above, even if variation occurs in the resistance R of the diffused resistors in the resistor ladder circuit 2 due to a temperature change, since the voltages of the nodes "B", "C", "D" and "E" are determined by a resistance ratio, the voltages of the nodes "B", "C", "D" and "E" maintain constant values, respectively. The reason for this is that, a resistance ratio (relative precision) between diffused resistors can be realized with less variation, in comparison with the precision of the absolute value of the resistance of the diffused resistors.

In ordinary cases, the control signal of a low level is supplied to the control signal input terminals TRM1 and TRM2. In this condition, therefore, the transfer gate transistors 10E, 10F and 10A are turned on, and the transfer gate transistors 10C, 10D and 10B are turned off.

Accordingly, the node "C" is connected to the node "G", so that the voltage $(3/5)V_A$ of the node "C" is outputted to the node "G".

Thus, the voltage of $(3/5)V_A$ is applied to the gate of the NMOS transistor 4. If the NMOS transistor 4 is in a saturated region, a drain current $I_{REF}$ of the NMOS transistor 4 can be expressed:

$$I_{REF}=K(V_G-V_{SS}-V_T)^2 \tag{4}$$

Here, if a variation occurs the threshold $V_T$ of the NMOS transistor, for example, if the threshold of the NMOS transistor becomes a threshold $V_{TA}$ which is higher than a desired threshold $V_T(V_{TA}>V_T)$, a drain current $I_{REFA}$ can be expressed as follows:

$$I_{REFA}=K(V_G-V_{SS}-V_{TA})^2\ (I_{REFA}<I_{REF}) \tag{5}$$

In order to make this current $I_{REFA}$ to the desired current value $I_{REF}$, the gate voltage of the NMOS transistor 4 is adjusted. Namely, the gate voltage of the NMOS transistor 4 is adjusted to $V_{GA}(V_{GA}>V_G)$.

Specifically, the control signal supplied to the control signal input terminal TRM1 is brought to a high level, and on the other hand, the control signal supplied to the control signal input terminal TRM2 is maintained at the low level. As a result, the transfer gate transistors 10C, 10D and 10A are turned on, and the transfer gate transistors 10E, 10F and 10B are turned off. Accordingly, the node "B" is connected to the node "G", so that the voltage $(4/5)V_A$ of the node "B"

is outputted to the node "G". Namely, the voltage on the node "G" becomes $V_{GA}(V_{GA}>V_G)$, with the result that the current $I_{REFA}$ approaches or becomes equal to $I_{REF}$.

To the contrary, if the threshold of the NMOS transistor becomes a threshold $V_{TB}$ which is lower than the desired threshold $V_T(V_{TB}<V_T)$, a drain current $I_{REFB}$ can be expressed as follows:

$$I_{REFB}=K(V_G-V_{SS}-V_{TB})^2 \ (I_{REFB}>I_{REF}) \quad (5)$$

In order to make this current $I_{REFB}$ to the desired current vale $I_{REF}$, the gate voltage of the NMOS transistor 4 is adjusted to $V_{GB}(V_{GB}<V_G)$.

Specifically, both of the control signals supplied to the control signal input terminals TRM1 and TRM are brought to a high level. As a result, the transfer gate transistors 10C, 10D and 10B are turned on, and the transfer gate transistors 10E, 10F and 10A are turned off.

Accordingly, the node "D" is connected to the node "G", so that the voltage $(2/5)V_A$ of the node "D" is outputted to the node "G". Namely, the voltage on the node "G" becomes $V_{GB}(V_{GB}<V_G)$, with the result that the current $I_{RFEB}$ approaches or becomes equal to $I_{REF}$.

Figure 4:
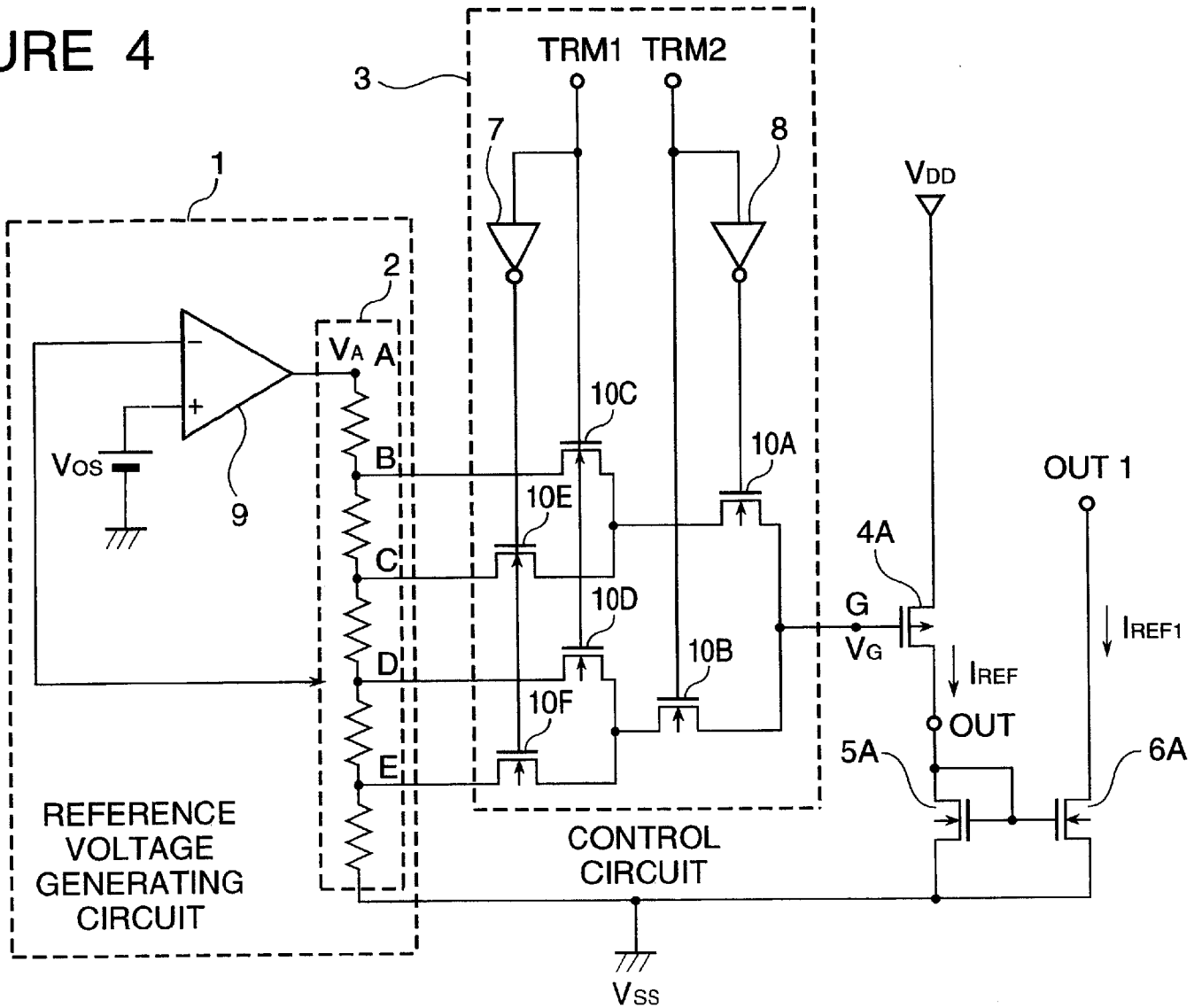
FIG. 4 is a detailed circuit diagram of a third embodiment of the reference current generating circuit in accordance with the present invention.

Referring to FIG. 4, there is shown a detailed circuit diagram of a third embodiment of the reference current generating circuit in accordance with the present invention, which is a modification of the second embodiment. Therefore, in FIG. 4, elements similar to those shown in FIG. 3 are given the same Reference Numerals.

As seen from comparison between FIGS. 3 and 4, the third embodiment includes a PMOS transistor 4A in place of the NMOS transistor 4 in the second embodiment, and a pair of NMOS transistors 5A and 6A in place of the PMOS transistors 5 and 6 of the current mirror circuit in the second embodiment. A gate of the PMOS transistor 4A is connected to the node "G, and a source of the PMOS transistor 4A is connected to the high voltage power supply terminal $V_{DD}$. A drain of the PMOS transistor 4A is connected to a drain and a gate of the NMOS transistor 5A and a gate of the NMOS transistor 6A, which have a source connected in common to the low voltage power supply terminal $V_{SS}$. A drain of the NMOS transistor 6A is connected to the output terminal OUT1 and constitutes a reference current output. Therefore, this third embodiment supplies a sink type reference current $I_{REF1}$. On the other hand, the second embodiment supplies a source type reference current $I_{REF1}$. This is only one difference between the second and third embodiments, and therefore, further explanation of the third embodiment will be omitted.

In the above mentioned second and third embodiments, the number of taps of the resistor ladder circuit 2 for supplying different divided voltages to the gate of the MOS transistor 4 or 4A, was four, but in order to generate a more precise reference current $I_{REF}$, the number of taps of the resistor ladder circuit 2 can be increased, for example, to 8, 16, 32, etc, by finely dividing the ladder resistor. If the number of taps is increased, the number of transfer gates in the control circuit 3 is correspondingly increased, and the bit number of the control signal is increased to 3, 4, 5, etc.

In other words, the above mentioned second and third embodiments has four taps in the resistor ladder circuit only for simplification of description, and therefore, the present invention is in no way limited to these embodiments. Namely, it should be noted that the present invention is in no way limited to the details of the illustrated structures but changes and modifications may be made within the scope of the appended claims. Therefore, for example, the resistors of the resistor ladder circuit can be formed of polysilicon resistor in place of the diffused resistor.

As seen from the above, the reference current generating circuit in accordance with the present invention is characterized in that the gate voltage of the MOS transistor for generating the reference current, is controlled by a selected one of a plurality of different divided voltages obtained by an internally provided resistor ladder circuit from a reference voltage. Accordingly, it is possible to supply the reference current having a high precision and a high stability in relation to a variation of the threshold $V_T$ of the MOS transistor caused by a variation in the manufacturing process and a temperature change. On the other hand, an external resistor, which was required in the prior art reference current generating circuit, becomes unnecessary, and the whole of the reference current generating circuit can be realized in an integrated circuit. Therefore, the reference current generating circuit in accordance with the present invention is suitable to be incorporated in an integrated circuit, and can reduce the cost of the semiconductor device.

What is claimed is:

1. A reference current generating circuit comprising:

a reference voltage generator for generating a predetermined reference voltage;

a resistor ladder circuit connected to said reference voltage generator and having a predetermined number of taps for outputting a corresponding number of different divided voltages obtained from a voltage generated by said reference voltage generator;

a control circuit, connected to the predetermined number of taps of said resistor ladder circuit, for outputting a selected divided voltage of said different divided voltages; and a MOS transistor having a gate connected to receive said selected divided voltage and a source connected to a reference power supply terminal;

wherein a current flowing through a drain of the MOS transistor is extracted as a predetermined output reference current.

2. A reference current generating circuit claimed in claim 1, wherein said control circuit includes a switcher connected between said taps of said resistor ladder circuit and said gate of said MOS transistor, said switcher being controlled such that said switcher is selectively closed in accordance with a voltage to be supplied to said gate of said MOS transistor in order to cause said MOS transistor to supply said predetermined output reference current.

3. A reference current generating circuit claimed in claim 2, wherein said switcher forms a tree structure between said taps of said resistor ladder circuit and said gate of said MOS transistor.

4. A reference current generating circuit claimed in claim 1, wherein said resistor ladder circuit is used in common with said reference voltage generator for generating said different divided voltages and also for a voltage trimming of said reference voltage of said reference voltage generator.

5. A reference current generating circuit claimed in claim 4, wherein said reference voltage generator includes a differential amplifier having a non-inverting input connected to a predetermined voltage and an output connected to one end of said resistor ladder circuit, an inverting input of said differential amplifier being connected to a predetermined divided voltage obtained from said resistor ladder circuit.

6. A reference current generating circuit claimed in claim 1, further including a current mirror circuit having an input current path connected in series to said drain of said MOS transistor and an output current path for supplying said predetermined output reference current.

7. A reference current generating circuit comprising:

a reference voltage generator for generating a predetermined reference voltage;

a resistor ladder circuit connected to said reference voltage generator and having a predetermined number of taps for outputting a corresponding number of different divided voltages obtained from a voltage generated by said reference voltage generator;

a control circuit, connected to the predetermined number of taps of said resistor ladder circuit, for outputting a selected divided voltage of said different divided voltages; and a first NMOS transistor having a gate connected to receive said selected divided voltage and a source connected to a low voltage power supply terminal;

wherein a current flowing through a drain of said first NMOS transistor is extracted as a predetermined output reference current.

8. A reference current generating circuit claimed in claim 7, wherein said control circuit includes a plurality of NMOS transistors connected in a tree structure between said taps of said resistor ladder circuit and said gate of said first NMOS transistor, said plurality of NMOS transistors being selectively on-off controlled by control input signals.

9. A reference current generating circuit comprising:

a reference voltage generator for generating a predetermined reference voltage;

a resistor ladder circuit connected to said reference voltage generator and having a predetermined number of taps for outputting a corresponding number of different divided voltages obtained from a voltage generated by said reference voltage generator;

a control circuit, connected to the predetermined number of taps of said resistor ladder circuit, for outputting a selected divided voltage of said different divided voltages; and a PMOS transistor having a gate connected to receive said selected divided voltage and a source connected to a high voltage power supply terminal;

wherein a current flowing through a drain of said PMOS transistor is extracted as a predetermined output reference current.

10. A reference current generating circuit claimed in claim 9, wherein said control circuit includes a plurality of NMOS transistors connected in a tree structure between said taps of said resistor ladder circuit and said gate of said PMOS transistor, said plurality of NMOS transistors being selectively on-off controlled by control input signals.

* * * * *